US009312594B2

(12) United States Patent
Burke et al.

(10) Patent No.: US 9,312,594 B2
(45) Date of Patent: Apr. 12, 2016

(54) LIGHTWEIGHT CAVITY FILTER AND RADIO SUBSYSTEM STRUCTURES

(71) Applicant: Intel Corporation, Santa Clara, CA (US)

(72) Inventors: Ian Burke, Lake Forest, CA (US); Jason Cook, Huntington Beach, CA (US); Ahmad Khanifar, Laguna Hills, CA (US)

(73) Assignee: Intel Corporation, Santa Clara, CA (US)

( * ) Notice: Subject to any disclaimer, the term of this patent is extended or adjusted under 35 U.S.C. 154(b) by 594 days.

(21) Appl. No.: 13/626,700

(22) Filed: Sep. 25, 2012

(65) Prior Publication Data

US 2013/0016025 A1 Jan. 17, 2013

Related U.S. Application Data

(63) Continuation-in-part of application No. 13/426,257, filed on Mar. 21, 2012.

(60) Provisional application No. 61/466,312, filed on Mar. 22, 2011.

(51) Int. Cl.
*H01P 1/208* (2006.01)
*H01P 7/06* (2006.01)
(Continued)

(52) U.S. Cl.
CPC ..... *H01P 11/007* (2013.01); *C23C 18/1605* (2013.01); *C23C 18/1653* (2013.01);
(Continued)

(58) Field of Classification Search
CPC ..... H01P 1/202; H01P 1/208; H01P 7/04; H01P 7/06
USPC ..... 333/206, 207, 202, 222–233
See application file for complete search history.

(56) References Cited

U.S. PATENT DOCUMENTS 2,565,643 A 8/1951 Baddour
4,265,690 A 5/1981 Lowenhar
(Continued)

FOREIGN PATENT DOCUMENTS

CN 1137842 A 12/1996
CN 102046710 A 5/2011
(Continued)

OTHER PUBLICATIONS

Lohinetong et al, "Surface Mounted Millimeter Waveguide Devices Based on Metallized Dielectric Foam or Plastic Materials", 2005, IEEE, 1409-1412.*
(Continued)

*Primary Examiner* — Robert Pascal
*Assistant Examiner* — Gerald Stevens
(74) *Attorney, Agent, or Firm* — Schwegman Lundberg & Woessner, P.A.

(57) ABSTRACT

Embodiments provide a novel fabrication method and structure for reducing structural weight in radio frequency cavity filters and radio subsystems such as antennas and filters. The novel structures are fabricated by electroplating the required structure over a mold, housing, or substrate. The electrodeposited composite layer may be formed by several layers of metal or metal alloys with compensating thermal expansion coefficients. The first or the top layer is a high conductivity material or compound such as silver having a thickness of several times the skin-depth at the intended frequency of operation. The top layer provides the vital low loss performance and high Q-factor required for such filter structures while the subsequent compound layers provide the mechanical strength.

5 Claims, 20 Drawing Sheets

(51) Int. Cl.

| | |
|---|---|
| ***H01P 11/00*** | (2006.01) |
| ***C23C 18/16*** | (2006.01) |
| ***C23C 28/02*** | (2006.01) |

(52) U.S. Cl.

CPC ..... *C23C28/021* (2013.01); *C23C 28/023* (2013.01); *H01P 1/208* (2013.01); *H01P 11/008* (2013.01); *H01P 7/06* (2013.01)

(56) References Cited

U.S. PATENT DOCUMENTS

| | | | | |
|---|---|---|---|---|
| 4,523,162 | A | 6/1985 | Johnson | |
| 5,329,687 | A | 7/1994 | Scott et al. | |
| 5,894,250 | A | 4/1999 | Ravaska et al. | |
| 5,993,934 | A | 11/1999 | Reese et al. | |
| 6,036,815 | A | 3/2000 | Peterson et al. | |
| 6,148,221 | A | 11/2000 | Ishikawa et al. | |
| 6,900,708 | B2 | 5/2005 | White et al. | |
| 7,471,172 | B2 * | 12/2008 | Holst et al. | 333/202 |
| 2001/0030587 | A1 | 10/2001 | Wulff | |
| 2009/0027403 | A1 | 1/2009 | Jung | |
| 2009/0302974 | A1 | 12/2009 | Lyons et al. | |
| 2010/0045406 | A1 | 2/2010 | Andreasson | |
| 2010/0328325 | A1 | 12/2010 | Sevigny et al. | |
| 2011/0030197 | A1 * | 2/2011 | Lagrotta et al. | 29/592.1 |
| 2012/0149464 | A1 | 6/2012 | Bone et al. | |
| 2012/0242425 | A1 | 9/2012 | Burke et al. | |

FOREIGN PATENT DOCUMENTS

| | | | |
|---|---|---|---|
| CN | 102214852 | A | 10/2011 |
| CN | 202977669 | U | 6/2013 |
| WO | WO-2012097178 | A1 | 7/2012 |
| WO | WO2013141897 | A1 | 9/2013 |

OTHER PUBLICATIONS

International Search Report and Written Opinion from International Search Authority for related PCT application serial No. PCT/US2012/057141, Feb. 5, 2013, 5 pp.

"U.S. Appl. No. 13/426,257, Final Office Action mailed Feb. 10, 2015", 14 pgs.

"U.S. Appl. No. 13/426,257, Non Final Office Action mailed Sep. 11, 2014", 11 pgs.

"U.S. Appl. No. 13/426,257, Response filed Jan. 12, 2015 to Non Final Office Action nailed Sep. 11, 2014", 13 pgs.

"U.S. Appl. No. 13/426,257, Response filed Jun. 10, 2014 to Restriction Requirement mailed Apr. 10, 2014", 1 pg.

"U.S. Appl. No. 13/426,257, Restriction Requirement mailed Apr. 10, 2014", 6 pgs.

"European Application Serial No. 12871637.0, Office Action mailed Nov. 14, 2014", 1 pg.

"International Application Serial No. PCT/US2012/057141, International Preliminary Report on Patentability mailed Oct. 2, 2014", 10 pgs.

"Chinese Application Serial No. 201280073379.8, Office Action mailed Feb. 1, 2016", W/ English Translation, 23 pgs.

"European Application Serial No. 12871637.0, Extended European Search Report mailed Feb. 15, 2016", 12 pgs.

Liberatoscioli, S, et al., "Innovative manufacturing technology for RF Passive devices combining electroforming and CFRP application", IEEE MTT-S International Microwave Symposium Digest, (Jun. 2008), 743-746.

Ma, Z, et al., "Microwave cavity resonators using hard X-ray Lithography", Microwave and Optical Technology Letters 47(4), (Nov. 2005), 353-357.

Varlese, Steven J. "Performance Characterization of a Shape Memory Composite Mirror", Proceedings 0f Spie vol. 5899, (Aug. 18, 2005), 58990Y-58990Y-9.

Vicenti, A, et al., "Tailoring Expansion Coefficients of Laminates: A New General Optimal Approach Based upon the Polar-Genetic Method", 6th World Congresses of Structural and Multidisciplinary Optimization9, (May 30, 2005), 10 pgs.

* cited by examiner

LIGHTWEIGHT CAVITY FILTER AND RADIO SUBSYSTEM STRUCTURES

RELATED APPLICATION INFORMATION

The present application is a continuation-in-part of U.S. patent application Ser. No. 13/426,257 filed Mar. 21, 2012, which claims priority under 35 U.S.C. Section 119(e) to U.S. Provisional Patent Application Ser. No. 61/466,312 filed Mar. 22, 2011, the disclosure of which are incorporated herein by reference in their entirety.

BACKGROUND OF THE INVENTION

1. Field of the Invention

This present invention is related in general to methods and structures for filtering radio waves. More particularly, the invention is directed to methods and structures for fabricating lightweight cavity resonator filters.

2. Description of the Prior Art and Related Background Information

Embodiments disclosed herein are related to a family of electrical circuits generally referred to as cavity resonator filters, which are used in radio frequency transceiver chains. Cavity resonator filters aid with receiving and transmitting radio waves in selected frequency bands. Typically, such filter structures are formed by coupling a number of coaxial cavity resonators or dielectrically loaded cavity resonators via capacitors, transformers, or by apertures in walls separating the resonators. It is noticeable that, unlike the general trend in electric and electronic devices where in recent years significant miniaturization has been achieved, efforts to downsize radio frequency ("RF") filters have been inhibited. This is primarily due to the fact that, to meet low loss and high selectivity requirements, air-cavity filters with dimensions approaching a fraction of free space wavelength are required. U.S. Pat. No. 5,894,250 is an example of such a filter implementation. FIG. 3 depicts a coaxial cavity filter that is commonly realized in practice which can achieve the electrical performance requirements.

The pursuit of improving the RF bandwidth efficiency in cellular infrastructure has led to increasingly stringent filtering requirements at the RF front end. High selectivity and low insertion loss filters are in demand in order to conserve valuable frequency spectrum and enhance system DC to RF conversion efficiency. Filter structures with spurious-free performance are needed to meet the out-of-band requirements. Furthermore, it is also desired that such filters have both low costs and small form factors to fit into compact radio transceivers units, often deployed remotely for coverage optimizations. The size and weight constraints are even more exasperated by the advent of multiple-input multiple-output ("MIMO") transceivers. Depending on implementation in a MIMO system, the number of duplexer filters may range from two to eight times that of a single-input single-output ("SISO") unit, all of which requires smaller and lighter filter structures. The desire for smaller size conflicts with the electrical performance requirement that resonators achieve very high unloaded Q-factor, which demands larger resonating elements.

An RF bandpass filter can achieve a higher selectivity by increasing the number of poles, i.e., the number of resonators. However, because the quality factor of the resonators is finite, the passband insertion loss of the filter increases as the number of resonators is increased. Therefore, there is always a trade-off between the selectivity and the passband insertion loss. On the other hand, for specified filter selectivity, certain types of filter characteristics that not only meet the selectivity requirement, but also result in a minimum passband insertion loss, are required. One such filter with these characteristics is the elliptic function response filter. Notable progress has been made on improving the size, and the in-band and out-of-band performance of the filters. However the size and the associated weight reduction of such structures present formidable challenges in remote radio head products.

FIG. 1 depicts the equivalent lumped element circuit schematic of a bandpass filter with capacitive coupling. FIG. 2 shows the distributed implementation where combinations of lumped and distributed components are being used. This filter structure is known as a combline filter. In this structure, the coaxial resonators are formed by a section of transmission line, the electrical length of which is typically between 30° and 90°. The electrical length of distributed lines dictates the position of spurious bandpass response of the filter in its stop band. The employment of the lumped capacitive elements allows for tunability but the mixed lumped distributed structure improves the spurious response suppression. For these reasons, the combline filter structure is very popular in practice. The implementation of the elliptic response is aided by the application of cross-coupling between the resonators.

Most cellular standards operate in Frequency Division Duplex ("FDD") mode. This means that for each transceiver, there are a pair of filters forming a duplexer filter structure. As mentioned earlier, more recent architectures, such as MIMO systems, incorporate several duplexers packaged in a single radio enclosure. The relatively large-sized cavity resonators coupled with expected large filter selectivity means that the duplexer(s) practically occupies a large space and forms the main mass of a remote radio head ("RRH") unit. This is an insurmountable design challenge particularly in the sub-gigahertz bands that are allocated to mobile telephony services.

The forgoing discussion defines the mechanical structure of a typical filter. The structure is normally machined or cast out of aluminum. In order to reduce the weight, the excess metal is machined off from the main body of the structure. This arrangement is shown in FIG. 3.

Accordingly, a need exists to reduce the weight of cavity resonator filter structures.

SUMMARY OF THE INVENTION

In a first aspect, the present invention provides a method for forming a lightweight cavity filter structure, comprising providing an insulated foam housing having a contoured surface of a cavity filter structure or inverse thereof, depositing a first layer of metal onto a surface of the insulated foam housing employing an electro-less plating process, and depositing a second layer of metal onto the first layer of metal employing an electroplating process. The total thickness of the first and second layers of metal is on the general order of magnitude of the skin depth associated with the operating radio frequency of the cavity filter structure.

In a preferred embodiment, the foam housing comprises polystyrene foam. The total thickness of the first and second layers of metal is preferably in the range of approximately 2 micrometers to approximately 10 micrometers. The first layer of metal preferably comprises copper, and the second layer of metal preferably comprises silver.

In another aspect, the present invention provides a cavity filter, comprising an insulated foam housing having a contoured surface of a cavity filter structure or inverse thereof, a first layer of metal deposited onto the insulated foam housing, and a second layer of metal deposited onto the first layer of metal. The total thickness of the first and second layers of metal is on the general order of magnitude of the skin depth associated with the operating radio frequency of the cavity filter structure.

In a preferred embodiment, the foam housing comprises polystyrene foam. The total thickness of the first and second layers of metal is preferably in the range of approximately 2 micrometers to approximately 10 micrometers. The first layer of metal preferably comprises copper, and the second layer of metal preferably comprises silver.

In another aspect, the present invention provides a method for forming an antenna reflector substructure for RF communication systems, comprising providing an insulated planar foam substrate having a first planar surface and a second planar surface, depositing a first layer of metal onto the first planar surface of the foam substrate, and, depositing a second layer of metal onto the first layer of metal.

In a preferred embodiment, the first layer of metal is preferably deposited onto the first planar surface of the foam substrate employing an electro-less plating process, and the second layer of metal is preferably deposited onto the first layer of metal employing an electroplating process. The foam substrate preferably comprises polystyrene foam.

In another aspect, the present invention provides an antenna reflector substructure for RF communication systems, comprising an insulated planar foam substrate having a first planar surface and a second planar surface, a first layer of metal deposited onto the first planar surface of the foam substrate, and a second layer of metal deposited onto the first layer of metal.

In a preferred embodiment, the first layer of metal is deposited onto the first planar surface of the foam substrate employing an electro-less plating process, and the second layer of metal is deposited onto the first layer of metal employing an electroplating process. The foam substrate preferably comprises polystyrene foam.

In another aspect the present invention provides a method for forming an antenna reflector and radiator substructure for RF communication systems, comprising providing an insulated planar foam substrate having a first planar surface and a second planar surface, depositing a first layer of metal onto the first planar surface of the foam substrate, depositing a second layer of metal onto the first layer of metal, applying a mask to the second planar surface which selectively masks regions of the second planar surface and exposes at least one exposed region on the second planar surface, depositing a third layer of metal onto the exposed region on the second planar surface of the foam substrate employing an electro-less plating process, removing the mask from the second planar surface, and depositing a fourth layer of metal onto the third layer of metal employing an electroplating process.

In a preferred embodiment, the first layer of metal is deposited onto the first planar surface of the foam substrate employing an electro-less plating process, the second layer of metal is deposited onto the first layer of metal employing an electroplating process, the third layer of metal is deposited onto the second planar surface of the foam substrate employing an electro-less plating process, and the fourth layer of metal is deposited onto the third layer of metal employing an electroplating process. The foam substrate preferably comprises polystyrene foam.

In another aspect, the present invention provides for an antenna substructure for RF communication systems, comprising an insulated planar foam substrate having a first planar surface and a second planar surface, a reflector comprising a first layer of metal deposited onto the first planar surface of the foam substrate and a second layer of metal deposited onto the first layer of metal, and a radiator comprising a third layer of metal selectively deposited onto the second planar surface of the foam substrate employing an electro-less plating process and a fourth layer of metal onto the third layer of metal employing an electroplating process.

In a preferred embodiment, the first layer of metal is deposited onto the first planar surface of the foam substrate employing an electro-less plating process, the second layer of metal is deposited onto the first layer of metal employing an electroplating process, the third layer of metal is deposited onto the second planar surface of the foam substrate employing an electro-less plating process, and the fourth layer of metal is deposited onto the first layer of metal employing an electroplating process.

In another aspect, the present invention provides a method for forming a radio subsystem, comprising providing an insulated foam substrate having first and second surfaces, depositing a first layer of metal onto the first surface of the foam substrate employing an electro-less plating or lamination process, and depositing a second layer of metal onto the first layer of metal employing an electroplating process.

Further features and aspects of the invention are set out in the following detailed description.

DETAILED DESCRIPTION OF THE INVENTION

Figure 1:
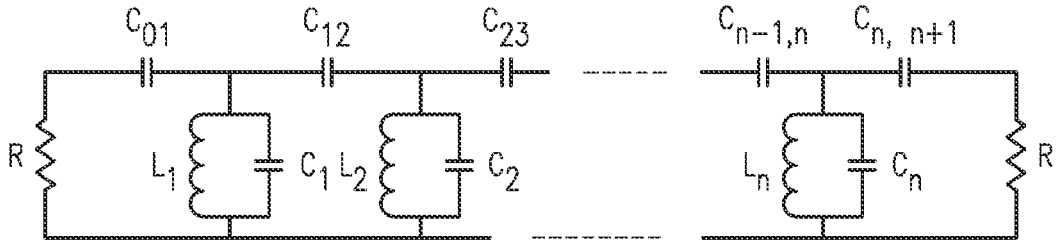
FIG. 1 is a schematic diagram of a lumped circuit having a capacitive coupled filter structure.
Figure 2:
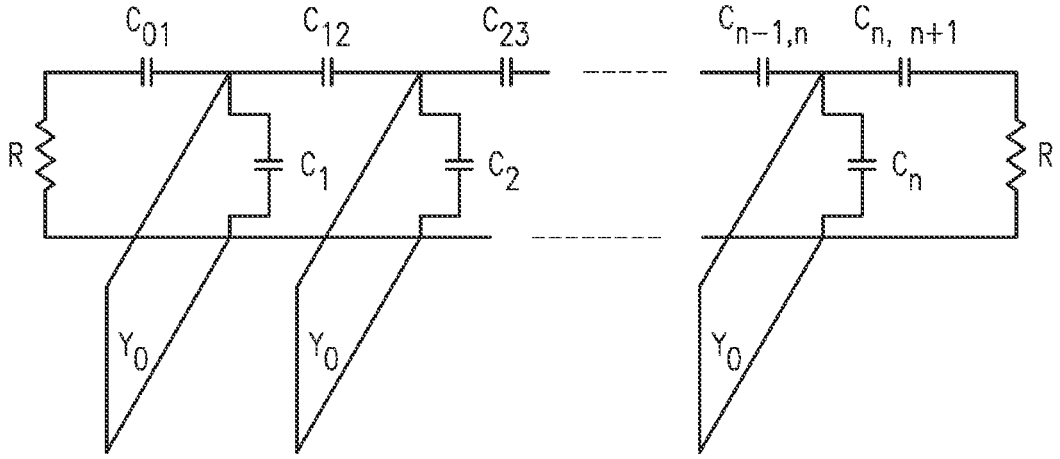
FIG. 2 is a schematic diagram of a lumped distributed RF filter.
Figure 3:
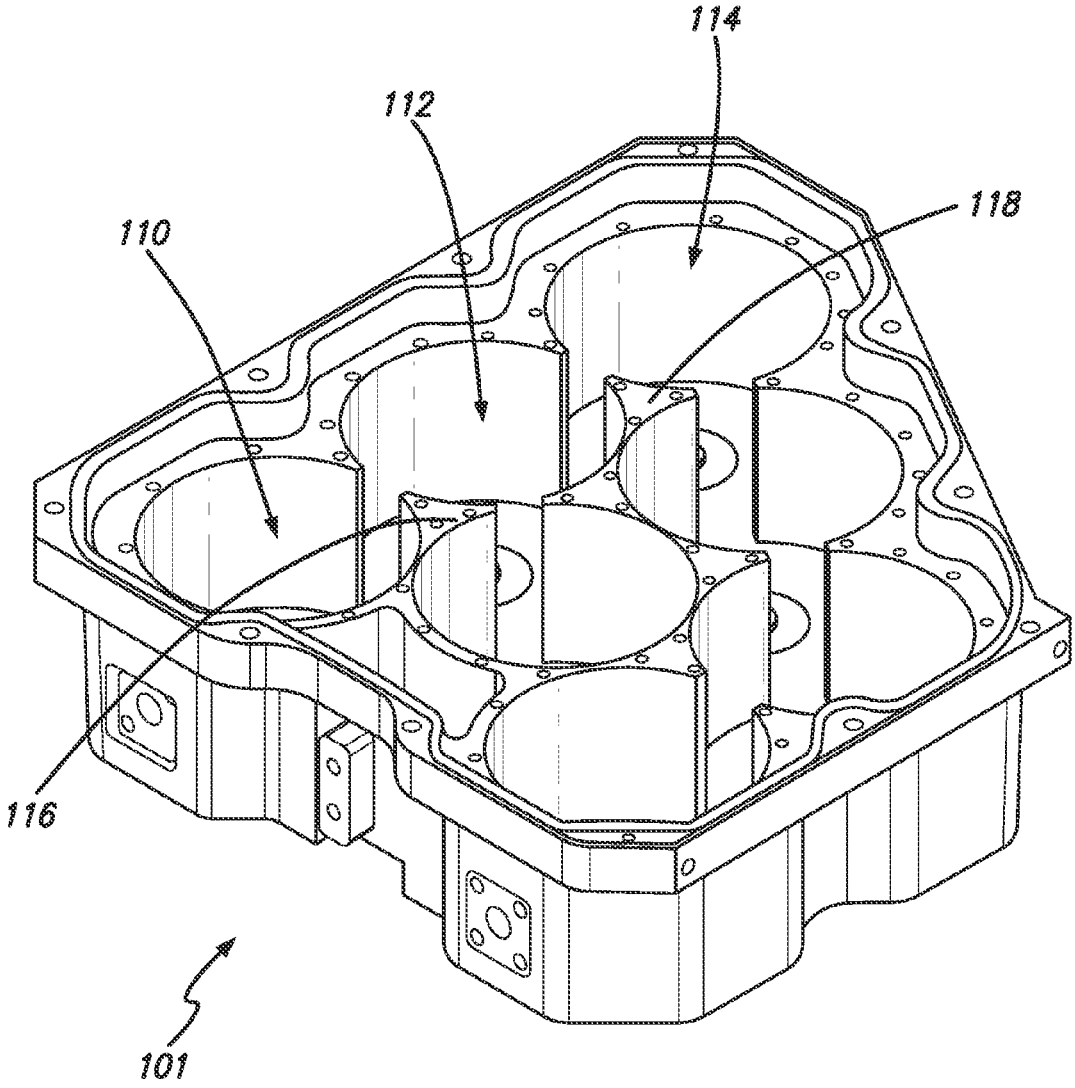
FIG. 3 (Prior Art)
FIG. 3 is a top, perspective view of a typical machined or cast aluminum combline duplexer filter structure as fabricated.

The mechanical structure of a conventional cavity based filter/duplexer housing 101 shown in FIG. 3 would have excessive weight. This is due to its massive and bulky resonator structure forming the cavity walls such as of the walls of cavities 110, 112, and 114 and partitions such as 116 and 118 between various compartments. The main embodiments disclosed herein relate to a manufacturing system and method that reduces the weight of such filter structures.

Within this disclosure, reference to various metal deposition processes including electro-less deposition and electroplating will be used as specific examples of implementations in one or more embodiments. As used herein and consistent with well known terminology in the art, electro-less plating generally refers to a plating process which occurs without the use of external electrical power. Electroplating generally refers to a process which uses an electrical current to deposit material on a conductive object. However, the use of the these specific plating processes should not be taken as being limited in nature as the methods disclosed herein may be practiced with other metal deposition techniques known in the art. Furthermore, various intermediate processing steps know in the art such as, but not limited to, pretreatment, cleaning, surface preparation, masking, and the use of additional layers to facilitate separation or adhesion between adjacent layers may not have been explicitly disclosed for the purposes of clarity but may be employed in one or more embodiments.

Moreover, as used throughout this disclosure, the various cross-sectional views of the layered structures during the fabrication process and the resulting cavity filter structures are representations to illustrate the cross-sectional views and may not necessarily be to scale.

Embodiments relate to novel approaches for the design and fabrication of filters similar, but not limited to the structures described herein and above. Embodiments accordingly also include improved filter structures. The electrical performance of filter structures like those discussed above is very much dependant on the electrical properties of the surface material. Thus, while the surface losses are critical, the cavity wall thickness is of less significance to extent the that, while it helps achieve the desired mechanical rigidity, it is responsible for a disproportionate weight of the finished product. Therefore, in order to reduce the weight of the filter structure, the cavity wall density would need to be reduced substantially. This is to say that the mass per unit volume of the filter structure can be reduced considerably if the filter structure is formed by a controlled electro-deposition process. Details of this process will be discussed in some detail in following sections.

Embodiments provide a method and apparatus for low cost fabrication of a single or multi-mode cavity filter leading to a lightweight structure. Before a detailed discussion of one or more embodiments is presented, the relevant electrical theory will be described first.

It is well known to those with ordinary skill in the art that an AC signal penetrates into a conductor by a limited amount, normally penetrating by only a few skin depths. The skin depth by definition is defined as the depth below the surface of the conductor at which the current density has fallen to 1/e (i.e., about 0.37) of the current density. In other words, the electrical energy conduction role of the conductor is restricted to a very small depth from its surface. Therefore, the rest of the body of the conductor, and in the case of a cavity resonator, the bulk of the wall, does not contribute to the conduction.

The general formulae for calculating skin depth is given in equation (1)

$$\sigma = \sqrt{\frac{2\cdot\rho}{2\pi\cdot f\cdot\mu_R\cdot\mu_0}} \cong 503\sqrt{\frac{\rho}{\mu_R\cdot f}} \tag{1}$$

where $\rho$ is resistivity (Ohm-meters), f=frequency (Hz), and $\mu_0=4\pi\times10^7$.

From equation (1) it is evident that the skin depth is inversely proportional to signal frequency. At RF and microwave frequencies, the current only penetrates the wave-guiding walls by a few skin depths. The skin depth for a silver plated conductor supporting a signal at 1 GHz is 2.01 μm. For copper the figure is very close (2.48 μm). Hence while the actual wave-guiding walls are a few millimeters thick, the required thickness of the electrical wall is in the order of 10 μm.

Based on the previous discussions, the electrical performance of the filter structure and, indeed, any conducting structure supporting radio frequency signal can have a much reduced conductor thickness without an impact on their electrical characteristics (such as resonator Q-factors and transmission coefficients).

Embodiments are based on utilizing this property of an electrical conductor. The conventional method of manufacturing cavity filters relies on machining or casting a solid bulk of aluminum or copper and plating the conducting surfaces by electroplating copper or silver. A typical cavity filter is constructed using a structural base metal (e.g., aluminum, steel, invar etc.) plated with copper followed by silver. The plated layer is normally several skin-depths thick. The bulk of the structure serves as a structural support providing mechanical rigidity and thermal stability. It is of course possible to cast the filter structure and electroplate subsequently to achieve the same end result.

One or more embodiments provide a fabrication method in which the filter structure is formed by electroplating over a mold or a former that is a mirror image of the cavity structure(s). This can be achieved by machining or casting a former out of a metal structure that serves as the cathode in the electroplating process. The plated layer is several skin-depths thick. Beyond what is required to satisfy the electrical conductions, an additional plating laminate will improve the mechanical strength at the expense of added weight. The electroplated cavity structure can include the coaxial resonator, or provision for bolt in resonators (either coaxial or dielectric).

Figure 4A:
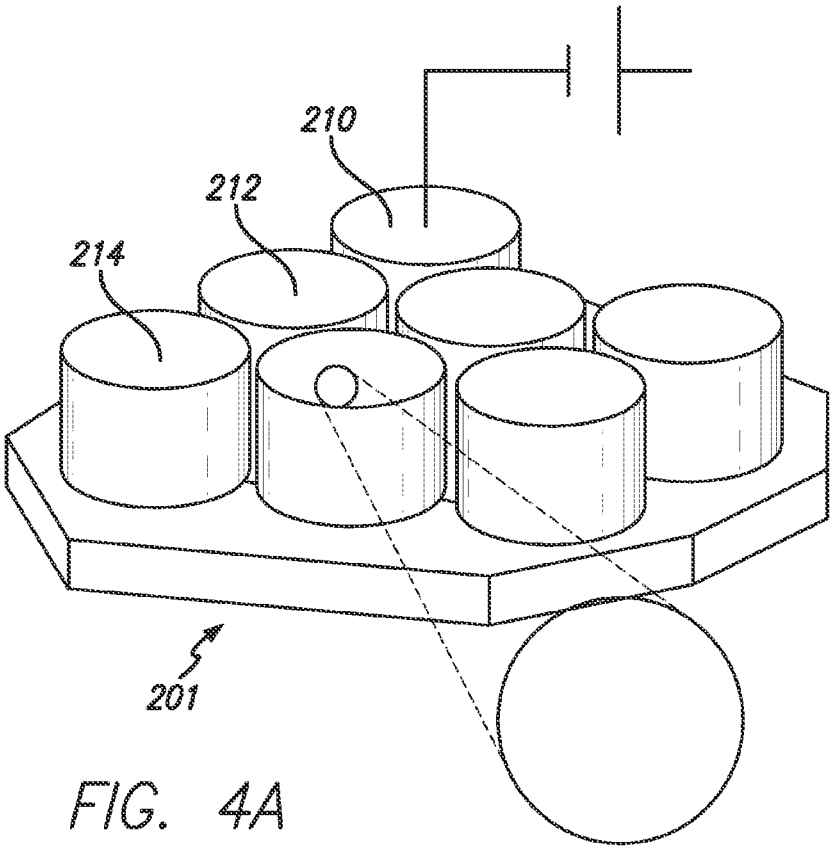
FIG. 4A is a top, perspective view of a metal mold used for the fabrication of a cavity filter structure in an embodiment.

FIGS. 4A-4D depict an exemplary apparatus and the structures at various steps in the fabrication process. FIG. 4A illustrates a metal mold 201 used for the fabrication of a cavity filter in an embodiment. The mold 201 has a contoured surface having a shape inverse to that of a cavity filter structure 230 shown in FIG. 4G. In general, the fabrication process comprises depositing materials onto the mold 210 and then separating the deposited materials from the mold 210 to result in the desired cavity filter structure 230. For example, the mold 201 has three cylinders 210, 212, and 214 which have an inverse shape to the cavities 240, 242, and 244 of cavity filter 230 shown in FIG. 4G. The metal mold 201 may be coupled to a voltage potential and placed in an electroplating bath which enables metal to be electroplated onto the metal mold 201. Cutaway, cross-sectional views of the structure as built are presented in FIGS. 4B-4G.

Figure 4B:
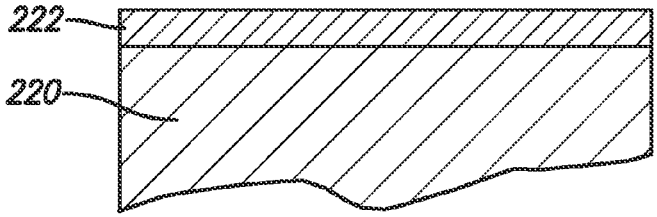
FIG. 4B is a representation of a cross-sectional view depicting a layer of electroplated metal deposited on a metal mold.
Figure 4C:
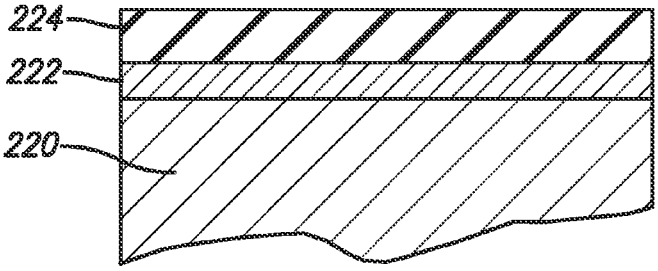
FIG. 4C is a representation of a cross-sectional view depicting a layer of laminate applied to the surface of the electroplated metal.

FIG. 4B illustrates an exemplary cross-sectional view depicting the resulting layer of electroplated metal 222 deposited on a metal mold 220. As depicted in FIG. 4C, a laminate 224 may be applied to the electroplated metal 222 to provide additional mechanical rigidity. The laminate 224 may comprise conducting or insulating materials in one or more embodiments. Examples of conducting materials may include metals and metal alloys.

Figure 4D:
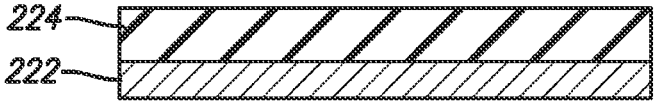
FIG. 4D is a representation of a cross-sectional view of the electroplated metal and laminate after the metal mold has been removed in an embodiment.

The electro-plated metal 222 may then be separated from the metal mold 220 to form a shell similar to that shown in cavity filter 230 comprising the electro-plated metal 222 and the laminate 224. While not explicitly described above for the purposes of clarity, additional steps may be employed to enable the separation of the electro-plated metal 222 from the mold 220. Such additional steps may include coating the mold 220 with a sacrificial layer which may be etched, liquefied, or dissolved to facilitate the separation of the electroplated metal 222 from the mold 220. FIG. 4D depicts a cross-sectional view of the electroplated metal 222 and the laminate 224 after the metal mold 220 has been separated from the electroplated metal 222 in an embodiment.

One or more embodiments provide a method of depositing several different layers with opposing thermal expansion rate to prevent the undesirable thermal expansion of the cavity dimensions.

Figure 4E:
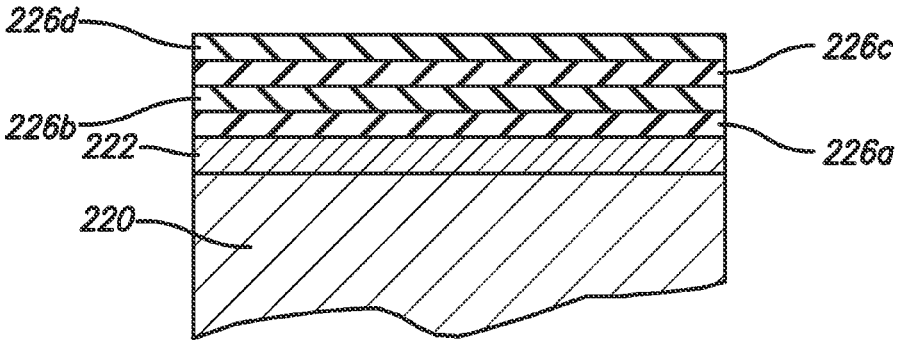
FIG. 4E is a representation of a cross-sectional view depicting multiple layers of laminate applied to the surface of the electroplated metal.
Figure 4F:
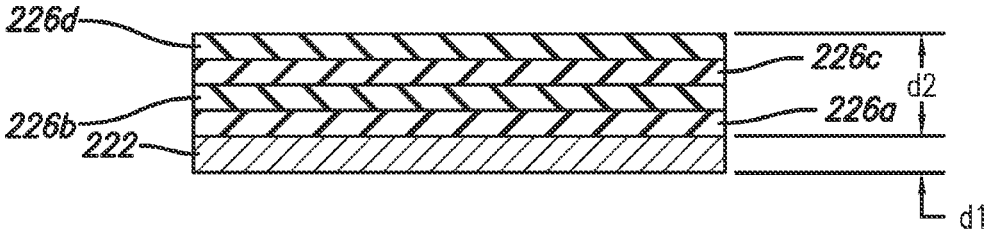
FIG. 4F is a representation of a cross-sectional view depicting the electroplated metal and the multiple layers of laminate after the metal mold has been removed.
Figure 4G:
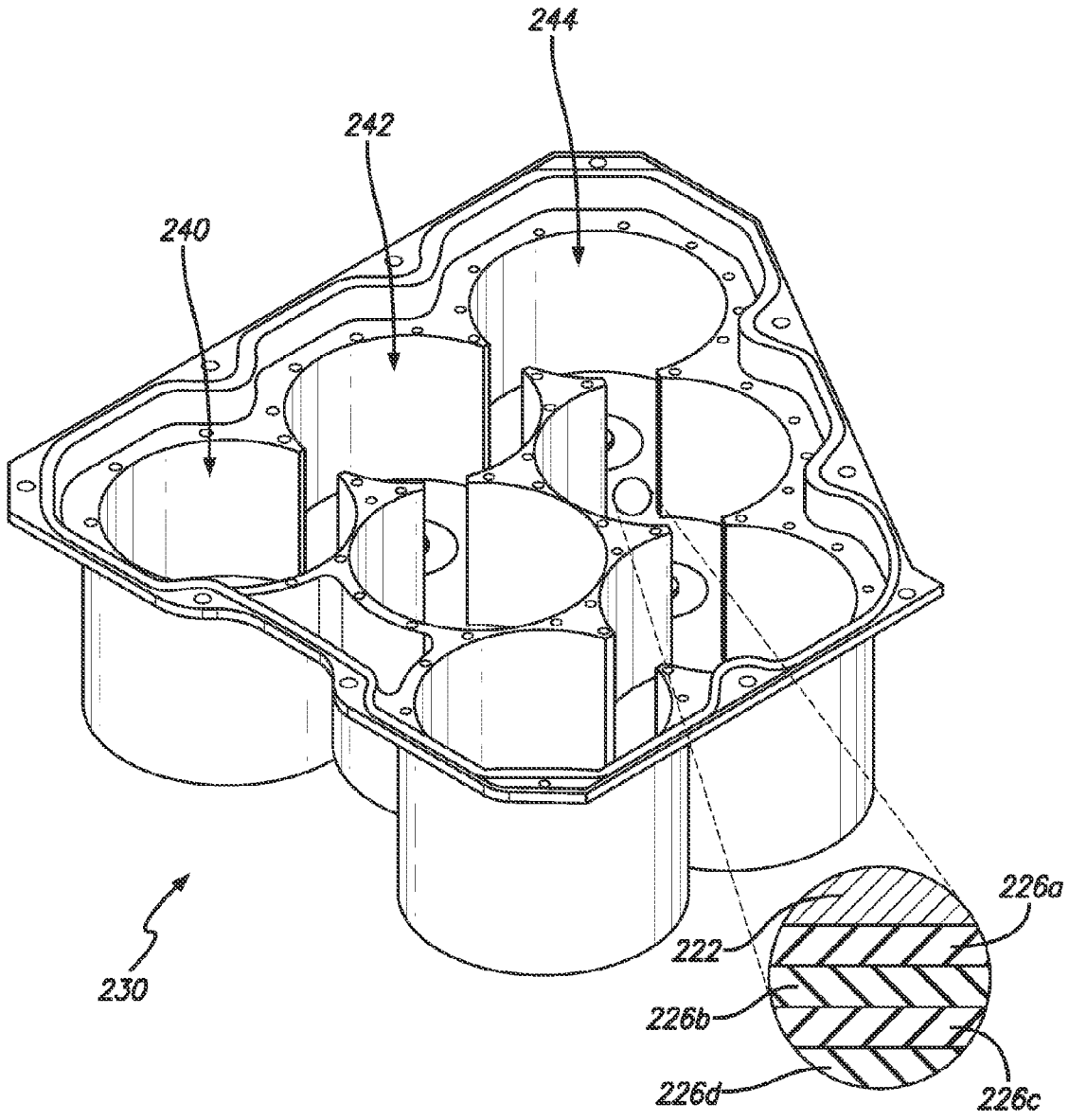
FIG. 4G is a top, perspective view of the resulting cavity filter structure.

FIG. 4E is a representation of a cross-sectional view depicting multiple layers of laminate 226*a*-226*d* applied to the surface of the electroplated metal 222. The layers of laminate may comprise metal, metal alloys, or insulating materials with compensating thermal expansion coefficients. For example, multiple layers of laminate may be employed such that each layer of the laminate has a thermal expansion coefficient opposite to that of an adjacent layer of laminate. As discussed above, the electroplated metal 222 may be separated from the mold 220. FIG. 4F illustrates a cross-sectional view depicting the electroplated metal 222 and the multiple layers of laminate 226*a*-226*d* after the metal mold 220 has been removed, and FIG. 4G depicts the final cavity filter structure 230.

As shown in FIG. 4F, the thickness of the electroplated metal 222 has a thickness represented as $d_1$ and the total thickness of the laminate layers is represented as $d_2$. The thickness of the electroplated metal 222 $d_1$ may be on the order of at least one to several times the skin depth associated with the operating radio frequency of the cavity filter structure in one or more embodiments. The thickness $d_1$ may be approximately 10 micrometers in an embodiment. The total thickness $d_2$ of the laminate 226*a*-226*d* is sufficient to provide mechanical rigidity to the electroplated metal 222 and may approximately one to several millimeters in an embodiment. The thickness $d_2$ of the laminate may be optimized based on the materials employed.

Another embodiment provides that the former may be made out of a metal of a non-metallic (insulator) material that is used as the cathode in the electroforming process but after an electro-less deposition process.

Figure 5A:
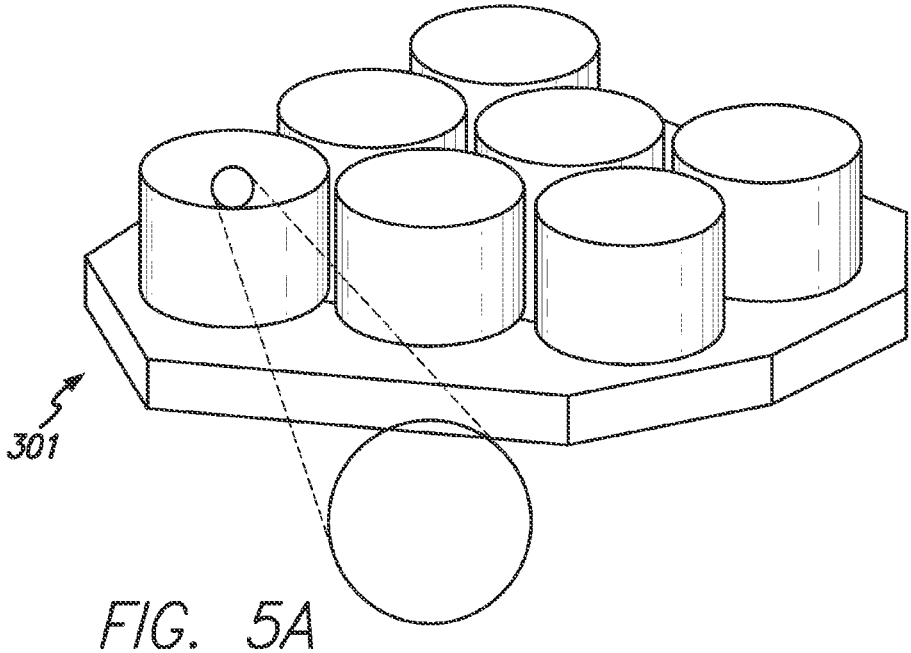
FIG. 5A is a top, perspective view of an insulating mold used for the fabrication of a cavity filter structure.
Figure 5B:
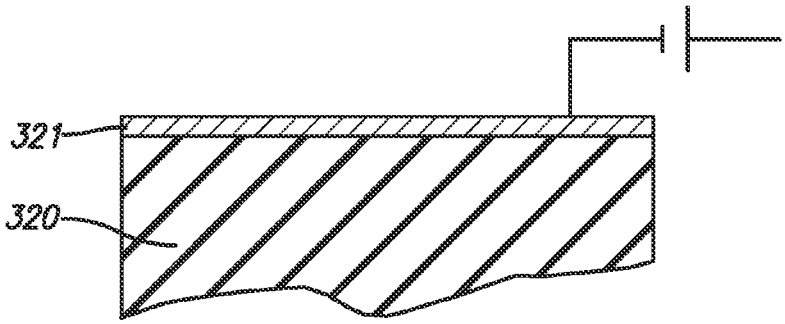
FIG. 5B is a representation of a cross-sectional view depicting a layer of electro-less deposited metal applied to the insulating mold.
Figure 5C:
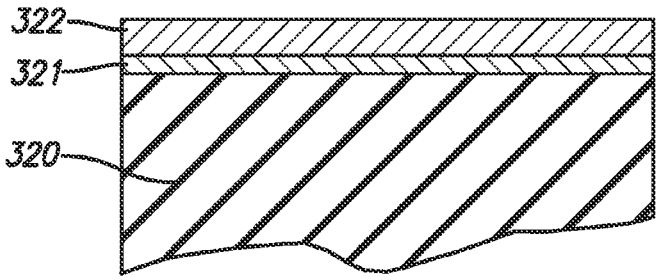
FIG. 5C is a representation of a cross-sectional view depicting a layer of electroplated metal deposited on the electro-less deposited metal.
Figure 5D:
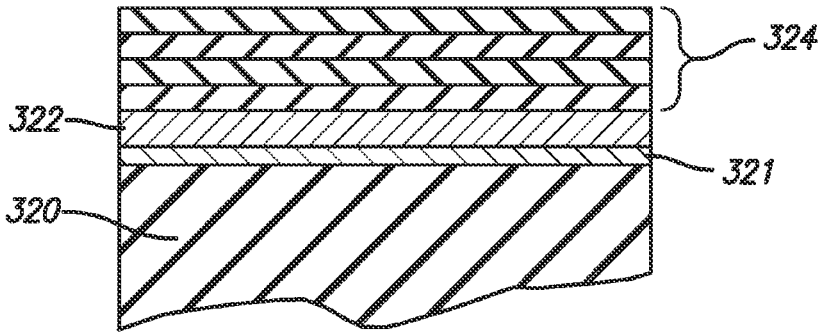
FIG. 5D is a representation of a cross-sectional view depicting one or more layers of laminate applied to the surface of the electroplated metal.
Figure 5E:
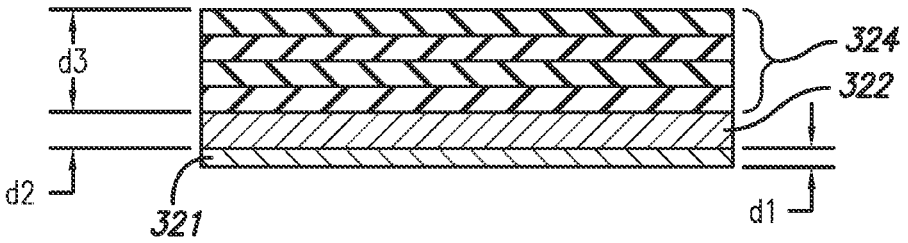
FIG. 5E is a representation of a cross-sectional view depicting the metal layers and the multiple layers of laminate after the insulating mold has been removed.
Figure 5F:
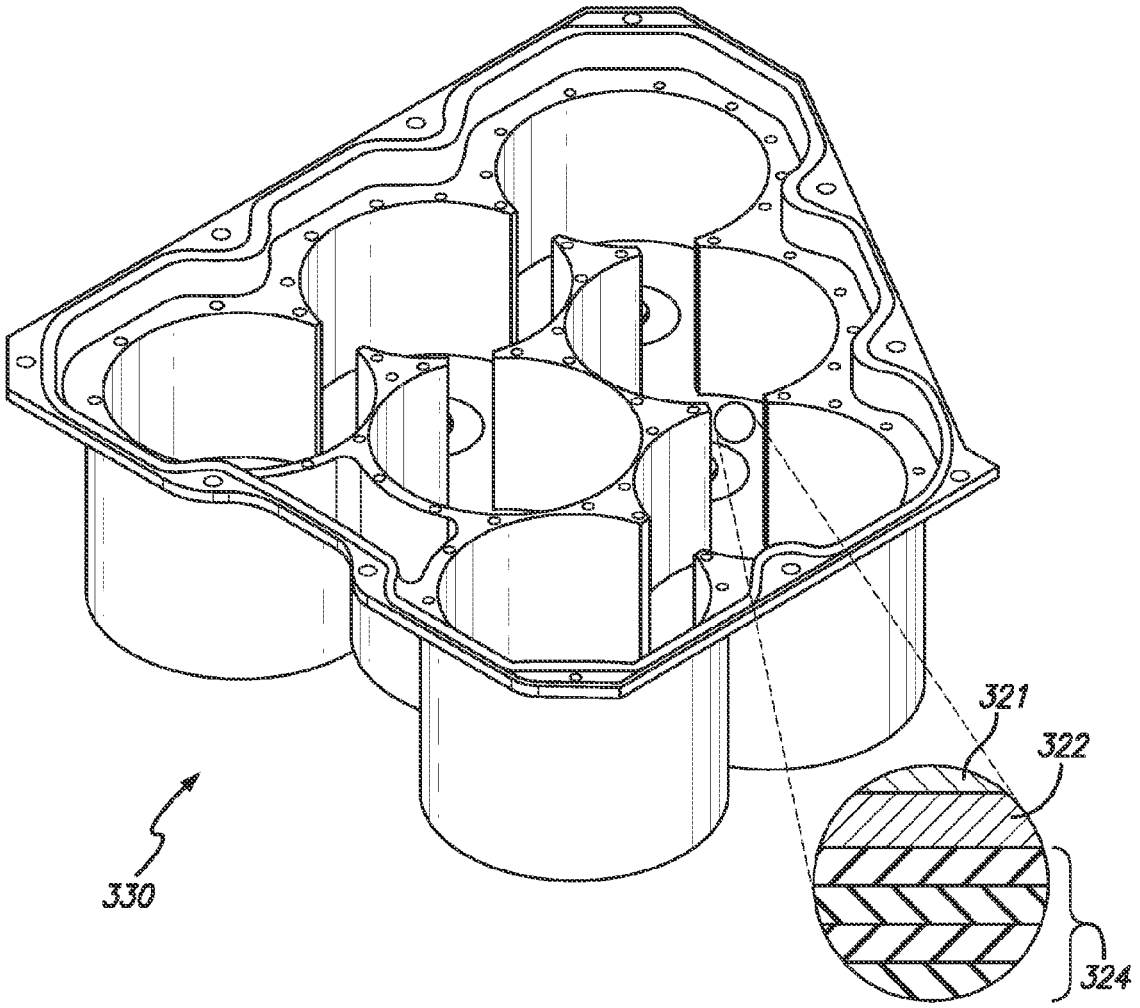
FIG. 5F is a top, perspective view of the resulting cavity filter structure.

FIGS. 5A-5E depict exemplary structure at various steps in an exemplary fabrication process, and FIG. 5F illustrates the resulting cavity filer structure 330. FIG. 5A illustrates an insulating mold 301 used for the fabrication of a cavity filter. The mold 301 has a contoured surface having a shape inverse to that of a cavity filter structure shown in FIG. 5F. An electroless deposited metal 321 may be formed on mold 301 using known electro-less deposition processes. FIG. 5B depicts the layer of electro-less deposited metal 321 applied to the insulating mold 320. The electro-less deposited metal 321 may then be connected to a voltage potential and placed in an electro-plating bath as discussed above. FIG. 5C depicts a layer of electroplated metal 322 deposited on the electro-less deposited metal 321.

In an embodiment, one or layers of laminate 324 are applied to the electroplated metal 322 as illustrated in FIG. 5D. The layers of laminate may comprise metal, metal alloys, insulating materials, or metal alloys interspersed with insulating materials with compensating thermal expansion coefficients. For example, multiple layers of laminate may be employed such that each layer of the laminate has a thermal expansion coefficient opposite to that of an adjacent layer of laminate. The mold 320 may be separated from the electroless deposited metal 321 as illustrated in FIG. 5E and as discussed above. The final cavity filter structure 330 is shown in FIG. 5F.

As shown in FIG. 5E, the electro-less deposited metal has a thickness represented as $d_1$, electroplated metal 322 has a thickness represented as $d_2$ and the total thickness of the laminate layers is represented as $d_3$. The thickness $d_1$ may be in the range of a fraction of micrometer to several micrometers in an embodiment. The thickness $d_2$ may be in the range of a fraction of a micrometer to several micrometers in an embodiment. The total thickness of the electro less metal 321 and the electroplated metal 322 $d_2$ (i.e., $d_1+d_2$) may be on the order of at least one to several times the skin depth associated with the operating radio frequency of the cavity filter structure in one or more embodiments and may be approximately 10 micrometers in an embodiment. The total thickness $d_3$ of the laminate 324 is sufficient to provide mechanical rigidity to the electro-less deposited metal 321 and the electroplated metal 322 and may be approximately one to several millimeters in an embodiment.

In an embodiment, yet another fabrication method is to mold the actual filter structure (the negative of what is shown in FIGS. 4A and 5A) out of an insulating compound such as light plastic or polystyrene with a good surface finish. The electrical performance will be achieved by metalizing the surface through electro-less or conductive paint. The thin metal deposit will be electroplated to an appropriate thickness based on the frequency of operation.

Figure 6A:
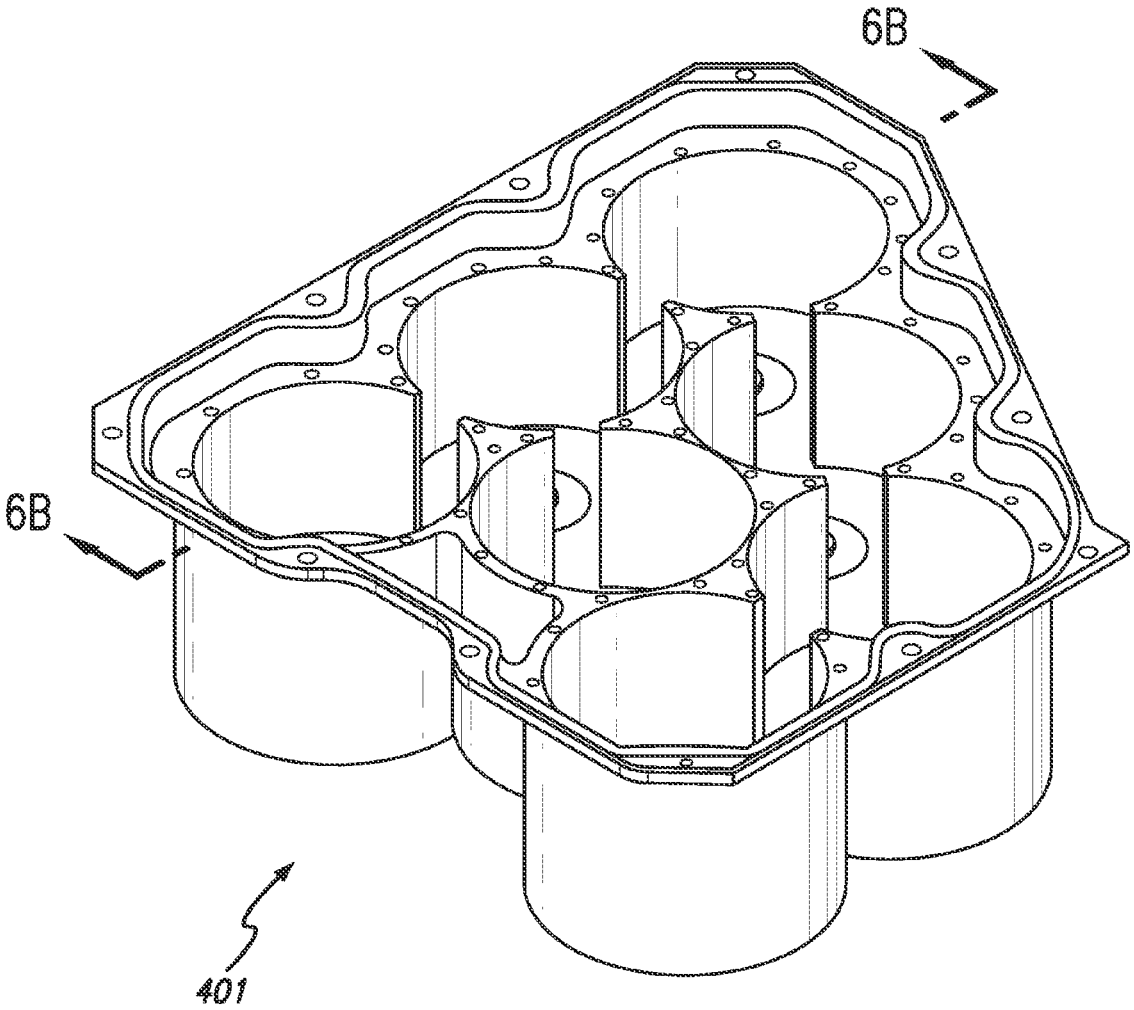
FIG. 6A is a top, perspective view of a housing having the shape and contours of a cavity filter structure.
Figure 6B:
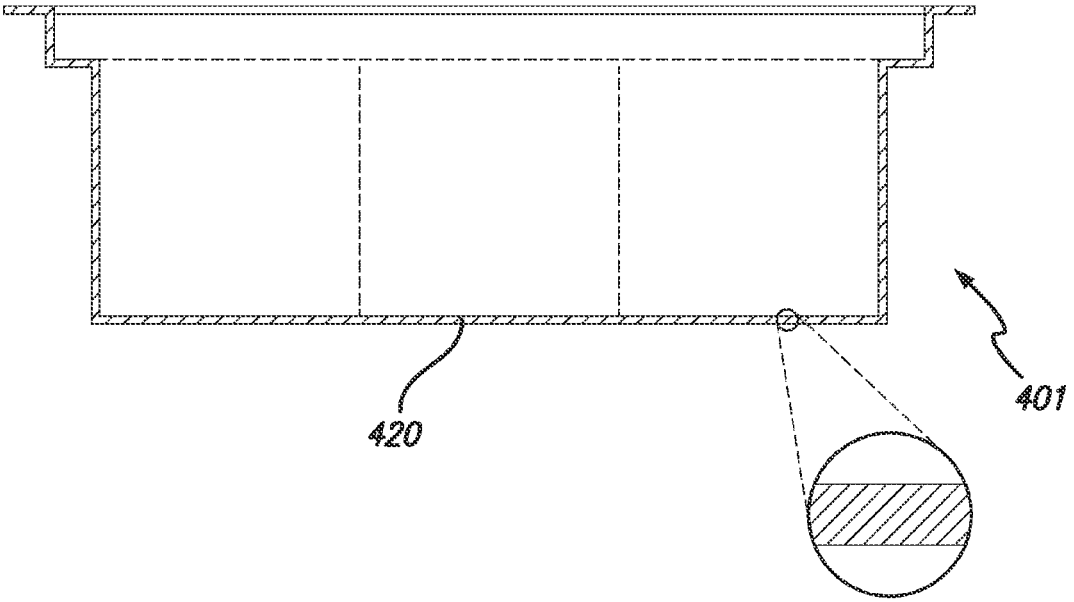
FIG. 6B is a cross-sectional view of the housing.

FIG. 6A is a top, perspective view of a housing 401 having the shape and contours of a cavity filter structure. The housing 401 may be formed out of a thin, insulating material which provides sufficient mechanical rigidity with minimal weight. Examples of insulating materials may include lightweight plastics such as, but not limited to, polystyrene. Additional braces and walls may be formed on the housing 401 for additional mechanical support. FIG. 6B depicts a cross-sectional view of the housing 401 in an embodiment, and further illustrates that insulating material 420 is much thinner than that of conventional structures.

Figure 6C:
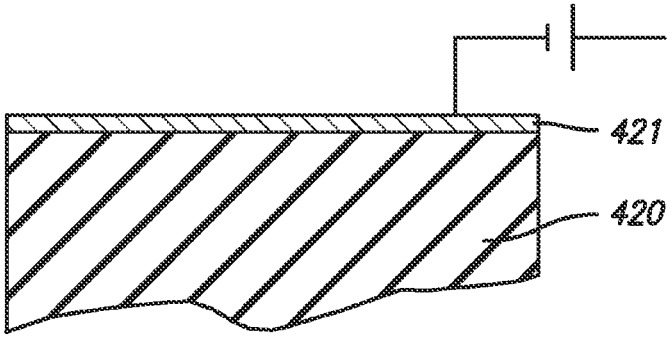
FIG. 6C is a representation of a cross-sectional view depicting an electro-less metal deposited on the surface of the housing.
Figure 6D:
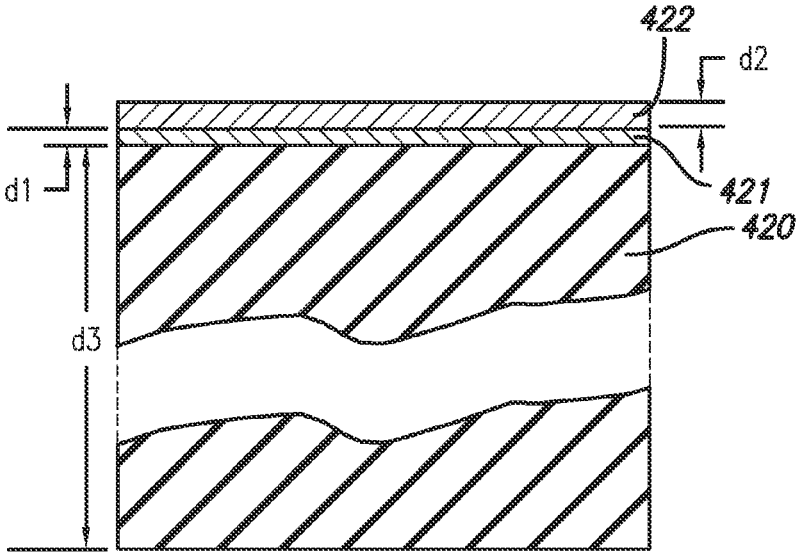
FIG. 6D is a representation of a cross-sectional view of electroplated metal deposited on the electro-less deposited metal.
Figure 6E:
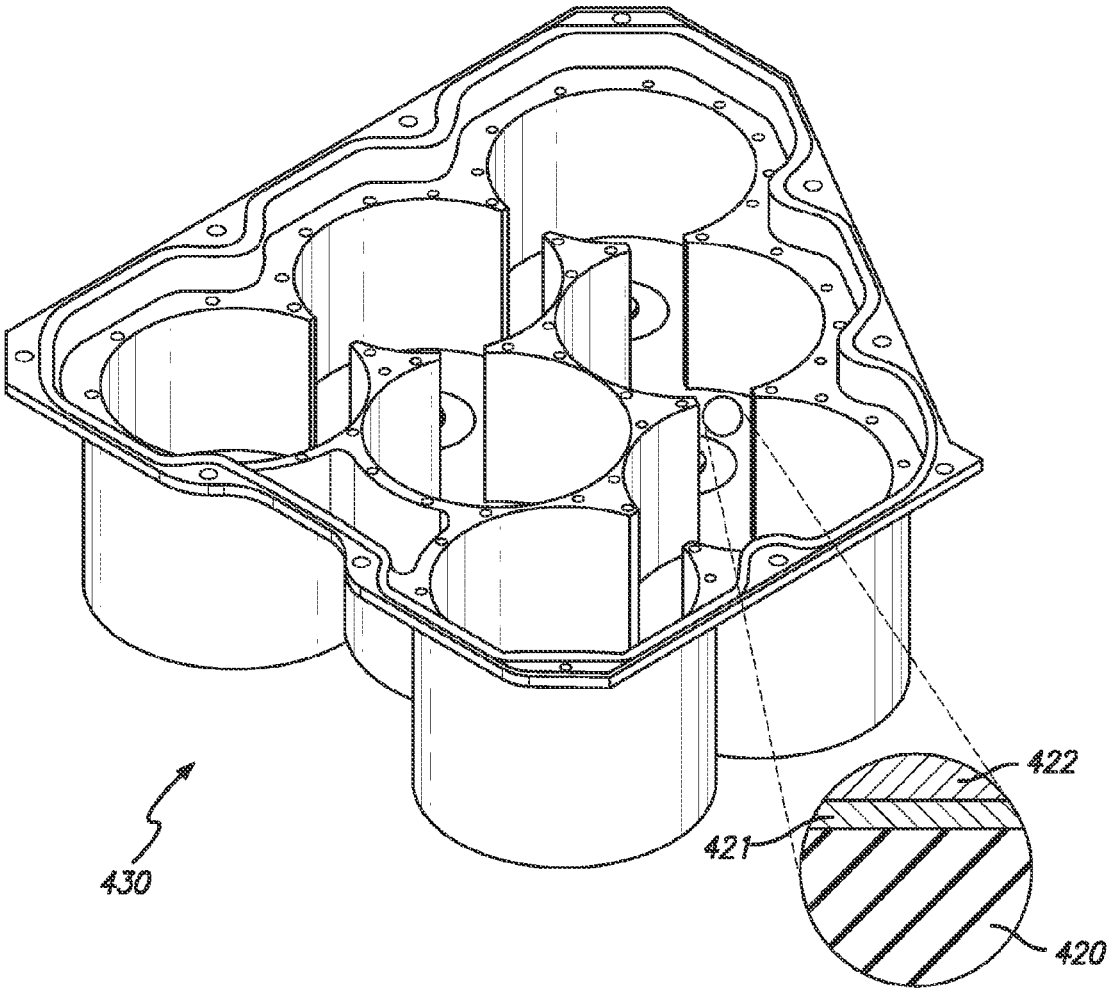
FIG. 6E is a top, perspective view of the resulting cavity filter structure.

A layer of electro-less deposited metal 421 is deposited on the insulating material 420 as discussed above and shown in FIG. 6C. This layer of electro-less deposited metal 421 may be coupled to a voltage potential to form a cathode in an electroplating process. The resulting cross-section of the electro-plated metal layer 422 deposited to the layer of electro-less metal is shown in FIG. 6D. As a result, the housing 401 now has contoured metal structure which exhibit properties of a conventional cavity filter but at a fraction of the overall weight. FIG. 6E depicts the final cavity filter structure 430. In an embodiment, insulating material 420 may be removed and other structural components may be coupled to the electro-less deposited metal.

As shown in FIG. 6D, the electro-less deposited metal 421 has a thickness represented as $d_1$, electroplated metal 422 has a thickness represented as $d_2$ and the housing insulating material 420 has a thickness represented as $d_3$. The thickness $d_1$ may be in a range approximately from a fraction of a micrometer to several micrometers and the thickness $d_2$ may be approximately in a range from a fraction of a micrometer to several micrometers in an embodiment. The total thickness of the electro-less metal 421 and the electroplated metal 422 $d_2$ (i.e., $d_1+d_2$) may be on the order of at least one to several times the skin depth associated with the operating radio frequency of the cavity filter structure in one or more embodiments and may be approximately 10 micrometers in an embodiment. The total thickness $d_3$ of the housing insulating material 420 is sufficient to provide mechanical rigidity to the electro-less deposited metal 321 and the electroplated metal 322 and may approximately one to several millimeters in an embodiment.

An embodiment provides related mechanical reinforcement of the electro-deposited filter shell. The ultra light filter structure formed by electroplating may suffer from mechanical rigidity. The structure is then filled by reinforcing foam. A variety of filler options are available for this task. This embodiment is not limited to a filler material and other metal or none metal reinforcement structures are also claimed.

An embodiment provides the provision of reinforcing the plated cavity structure by insertion of a reinforcement structure before the plating. The reinforcing structure can be fused with the electrodeposited structure, adding mechanical strength and stability.

An embodiment relates to the method of reinforcing the overall structure by adding, welding, or brazing additional plates or laminates to the structure to achieve mechanical strength while minimizing the added weight.

An embodiment of invention extends the application of technique described above to other radio subsystems such as antennas, antenna array structures, integrated antenna array-filter/duplexer structures and active antenna arrays.

One or more embodiments employ a technique in which the body of the filter structure is made of a foam material such as polystyrene or a similar light weight substance. Other types of lightweight materials and foam materials including polymer foams, thermoplastic foams, polyurethane foams, plastic foams, and other materials are contemplated in one or more embodiments. The internal surface of cavities would electroplated by copper or several different layers of electro-deposited metal. The final plating stage may be a material with highest electrical conductivity such as silver, copper, etc. One or more embodiments form the filter by electroplating over a light weight foam material such as polystyrene. In one or more embodiments, the mold for the filter structure—and here the emphasis is on polystyrene structures—can be made as positive or negative, i.e., the supporting structure could be filling the actual cavity or the filter structure can be manufactured exactly like a regular metallic structure with hollow cavities in which case the internal walls are plated by metal to form the resonators. In an embodiment, the cavity will be molded to achieve the required surface finish.

The electro depositing of the final layers (the surface exposed to electromagnetic energy) may be silver or copper to minimize the loss. This plated layer thickness depends on frequency of the filter and may vary between 2-10 micrometers ("μm"). The underlying layers may be copper.

The plating of the molded structure may start by employing an electro-less process. This layer may be very thin and makes the polystyrene surface conductive. Further thickness can be added by electroplating copper to increase thickness. Of course, further silver plating can enhance conductivity. The silver plating of the copper surface will be very similar to the plating performed on conventional casted aluminum structure.

The difference between the filters which are electroformed (over a mandrel) discussed in other embodiments and the polystyrene-filter is the fact that, in such filters, the final products are actually formed as thin shells as opposed to polystyrene filters that are formed by plating over a molded structure, i.e. polystyrene or other types of polymers/plastics.

As discussed above, FIGS. 6A-6E illustrate an exemplary structure at various steps in the exemplary fabrication process. In one or more embodiments, the insulating housing material 420 may be formed out of a foam material such as polystyrene foam or other foam materials. Other types of lightweight materials and foam materials including polymer foams, thermoplastic foams, polyurethane foams, plastic foams, and other materials are contemplated in one or more embodiments.

Figure 5G:
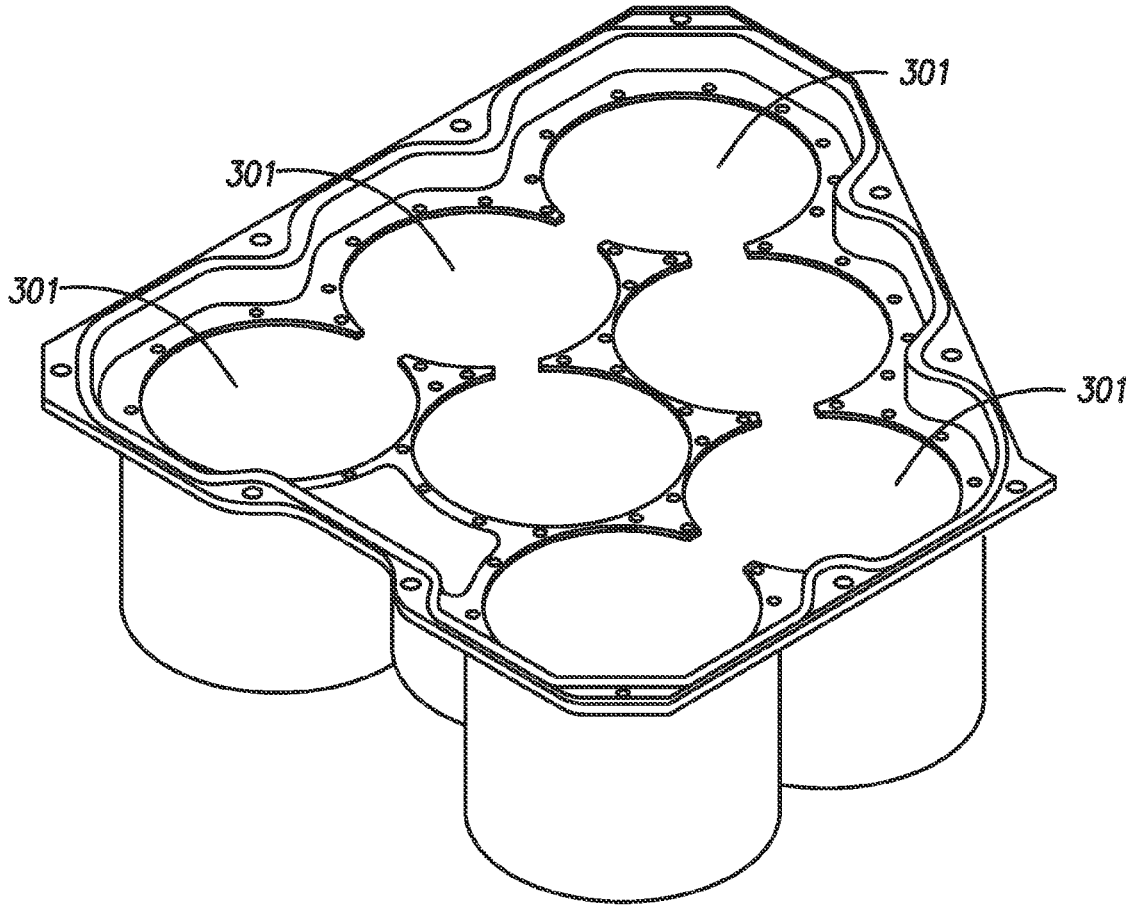
FIG. 5G is a top, perspective view of the resulting cavity filter structure with foam within the cavities.

Alternatively, a cavity filter may also be formed employing the processing steps illustrated in FIGS. 5A through 5C. In an embodiment, the mold 301 may comprise a foam material as discussed above. An electro-less deposited metal 321 is formed on the mold, and an electro-plated metal 322 is formed on electro-less deposited metal 321. In an embodiment, the laminate layers are not applied to the electro-plated metal 322 and the mold 301 is not removed from the electro-less deposited metal layer 321. The resulting cavity filter would be similar to that depicted by cavity filter 330, but with the foam mold 301 remaining within the cavities in one or more embodiments, as illustrated in FIG. 5G.

Figure 7A:
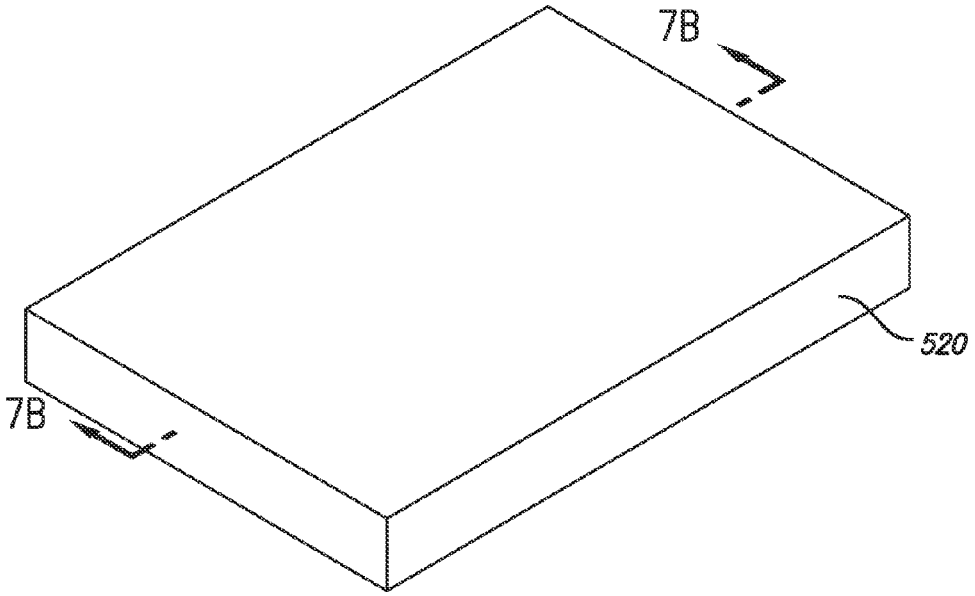
FIG. 7A is a perspective view of a substrate comprising a foam material in an embodiment.
Figure 7B:
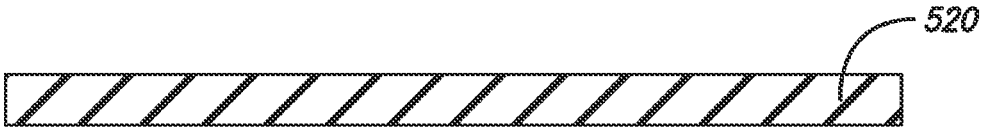
FIG. 7B is a cross-sectional view of the substrate.
Figure 7C:
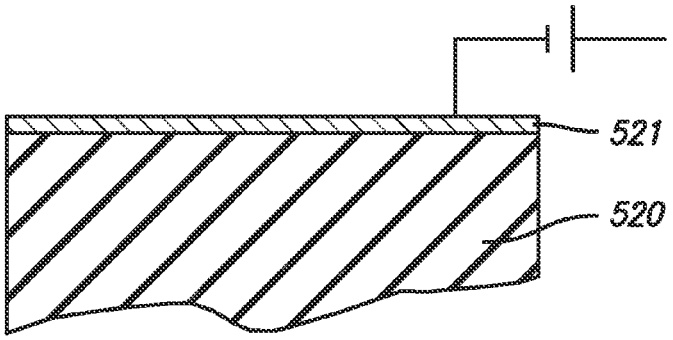
FIG. 7C is a representation of a cross-sectional view depicting an electro-less metal deposited on the surface of the substrate.
Figure 7D:
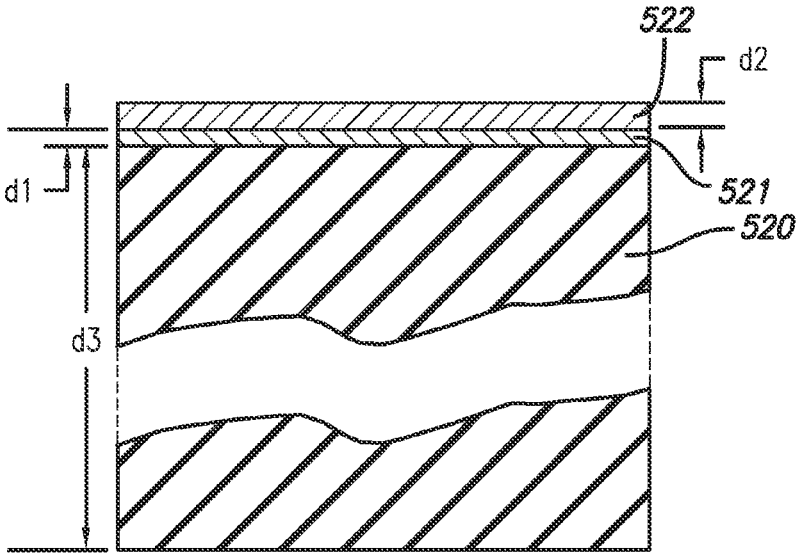
FIG. 7D is a representation of a cross-sectional view of electroplated metal deposited on the electro-less deposited metal.
Figure 7E:
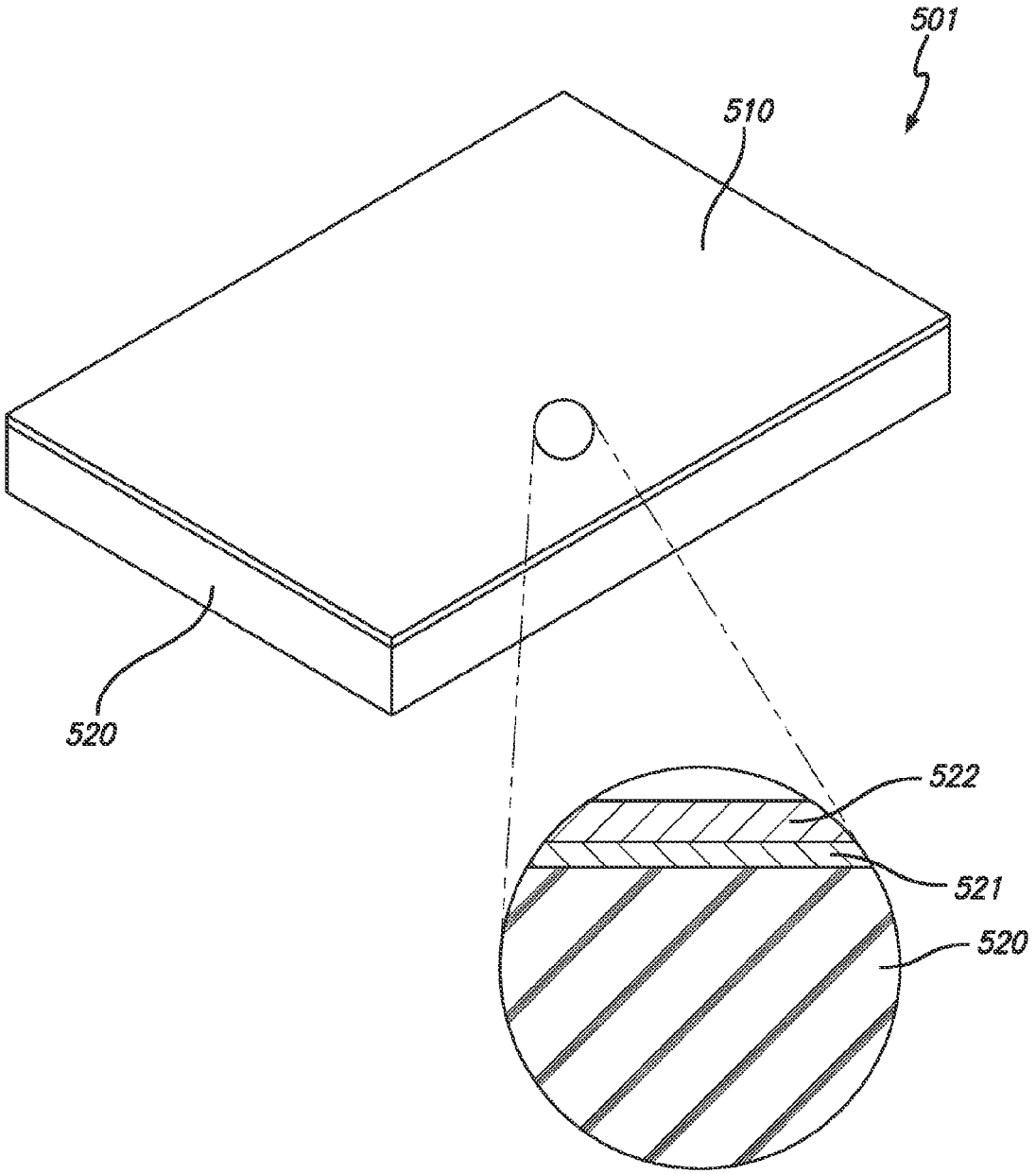
FIG. 7E is a top, perspective view of the resulting antenna substructure structure.
Figure 8A:
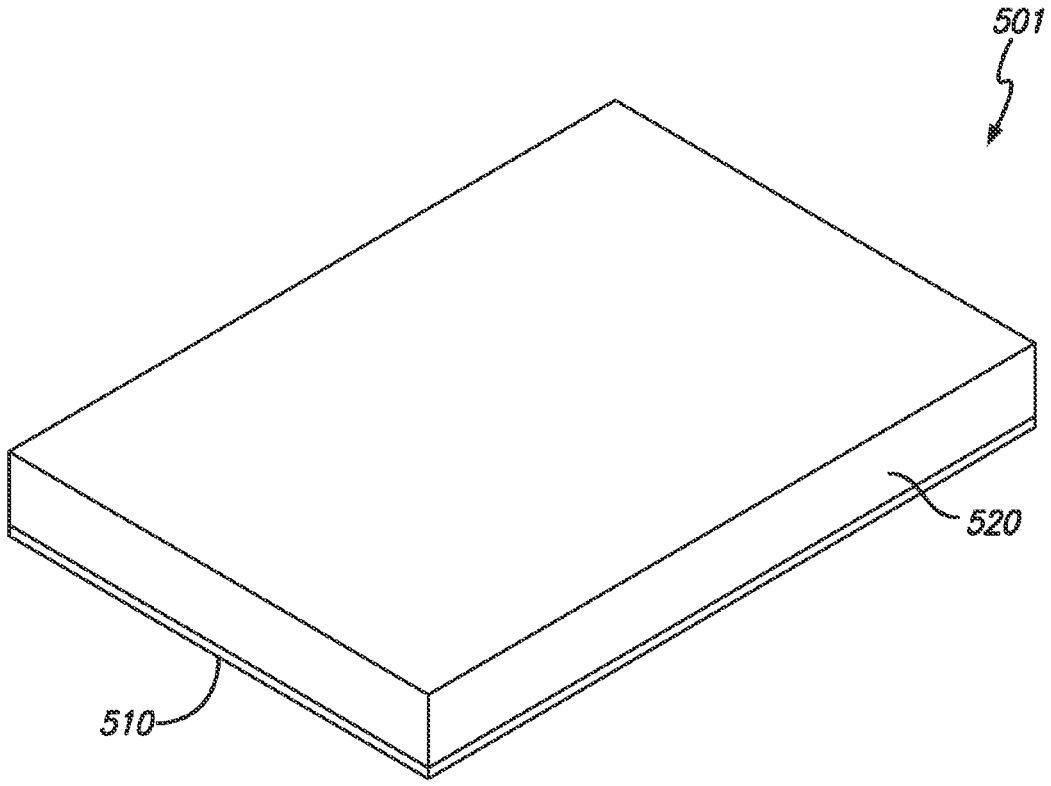
FIG. 8A is a perspective view of the antenna substructure viewed from an opposite direction.
Figure 8B:
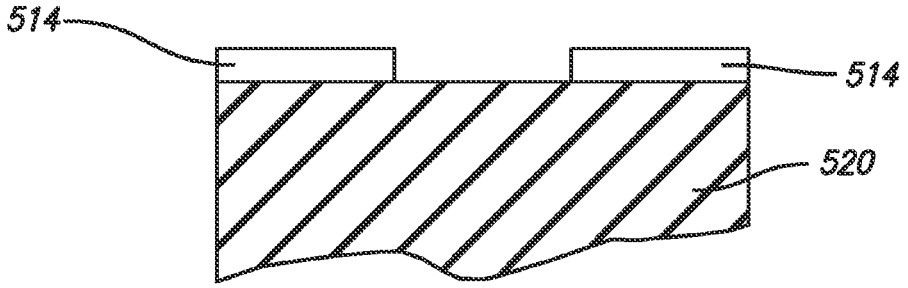
FIG. 8B is a representation of a mask material applied to the substrate.
Figure 8C:
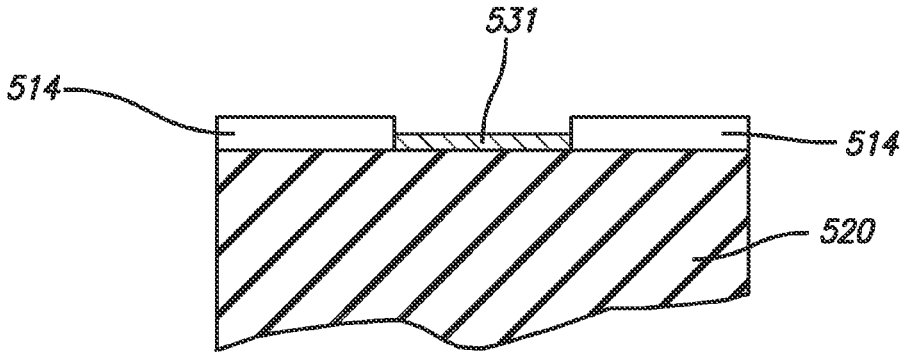
FIG. 8C is a representation of a cross-sectional view depicting an electro-less metal deposited on the surface of the substrate.
Figure 8D:
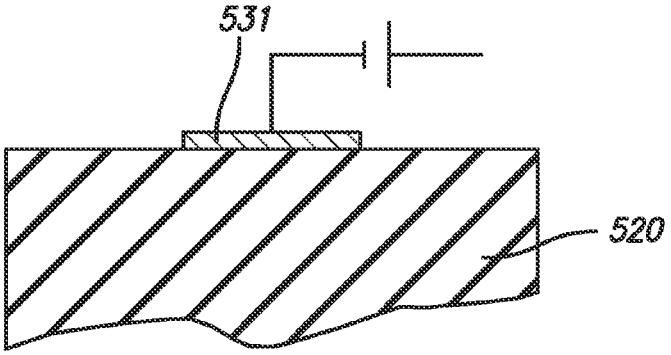
FIG. 8D is a representation of a cross-sectional view of the mask material removed.
Figure 8E:
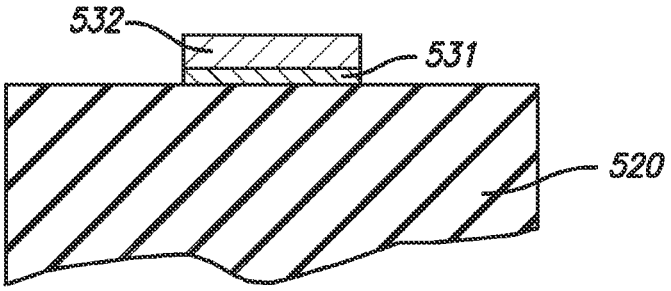
FIG. 8E is a representation of a cross-sectional view of electroplated metal deposited on the electro-less deposited metal.
Figure 8F:
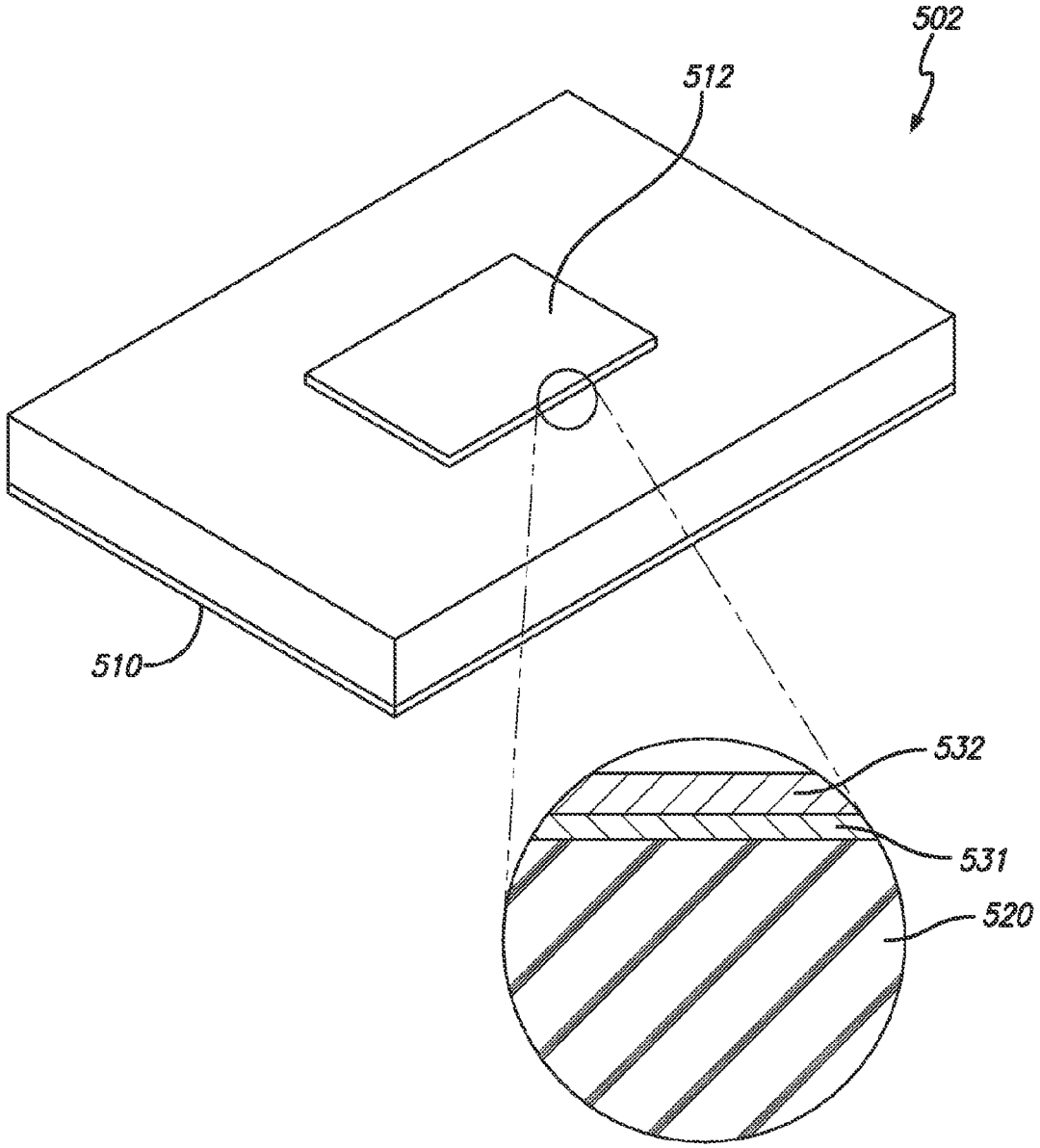
FIG. 8F is a perspective view of the resulting antenna substructure.

This metal deposition process may be applied to other structures such as those for radio subsystems as illustrated in FIGS. 7E and 8F. Among the types of radio subsystems which may be fabricated employing the techniques described herein include antennas, filters, antenna array structures, integrated antenna array-filter/duplexer structures, and active antenna arrays. Teachings related to antennas may be found in U.S. Publication 2010/0265150 for Arvidsson which is incorporated herein by reference in its entirety.

FIGS. 7A-7E illustrates formation of an antenna reflector substructure. FIG. 7A is a perspective view of a substrate 520 comprising a foam material in an embodiment and FIG. 7B is a cross-sectional view of the substrate 520. In one or more embodiments, the substrate 520 may be an insulating material such as plastic or a foam material, polystyrene foam, or other foam materials. Other types of lightweight materials and foam materials including polymer foams, thermoplastic foams, polyurethane foams, plastic foams, and other materials are contemplated in one or more embodiments.

A layer of electro-less deposited metal 521 is deposited on the insulating substrate 520 as discussed above and shown in FIG. 7C. This layer of electro-less deposited metal 521 may be coupled to a voltage potential to form a cathode in an electroplating process. The resulting cross-section of the electro-plated metal layer 522 deposited to the layer of electro-less metal is shown in FIG. 7D. FIG. 7E depicts the antenna substructure 501 having a ground plane 520. In one or more embodiments, metals 521 and 522 may be either copper or silver.

As shown in FIG. 7D, the electro-less deposited metal 521 has a thickness represented as $d_1$, electroplated metal 522 has a thickness represented as $d_2$ and the substrate 520 has a thickness represented as $d_3$. The thickness $d_1$ may be in a range approximately from a fraction of a micrometer to several micrometers and the thickness $d_2$ may be approximately in a range from a fraction of a micrometer to several micrometers in an embodiment. The total thickness of the electro-less metal 421 and the electroplated metal 422 $d_2$ (i.e., $d_1+d_2$) may be tailored to meet the requirements for an RF communication system for example. The total thickness $d_3$ of the substrate 520 is sufficient to provide mechanical rigidity to the electro-less deposited metal 521 and the electroplated metal 522 and may approximately one to several millimeters in an embodiment.

Antenna substructure 501 may be further modified to form an antenna reflector and radiator substructure 502 having a patch radiating element 512 in an embodiment as depicted in FIG. 8F. FIG. 8A is a perspective view of the antenna substructure 501 viewed from an opposite direction from that of FIG. 7E. In one or more embodiments, metal may be selectively applied to the surfaces of the foam substrate 520. As shown in FIG. 8B, a mask 514 may be temporarily applied to the foam substrate 520 to selectively expose regions for deposition of the electro-less deposited materials 531. In an embodiment, the mask 514 may be applied through a photolithography process. In an embodiment, the mask 514 may comprise a sheet having apertures corresponding to the selected regions which may be applied to the foam substrate 520. FIG. 8C is a representation of a cross-sectional view depicting an electro-less metal 531 deposited on the surface of the substrate 520. The mask 514 may be removed. FIG. 8D is a representation of a cross-sectional view of the mask material removed leaving the electro-less deposited metal layer 531. The resulting cross-section of the electro-plated metal layer 532 deposited to the layer of electro-less metal 531 is shown in FIG. 8E. The thickness of metal layers 531 and 532 may be tailored for the RF communication system. Metal layers 531 and 532 may comprise silver or copper in an embodiment. FIG. 8F depicts the resulting antenna substructure 502 having a ground plane 520 and a radiating patch 512.

Hence, the techniques described herein may be employed to form layers of conductive material on one or both sides of a lightweight foam substrate 520. The layers may be continuous such as conductive surface 510 which may be employed as a ground plane in an antenna system for example, or the layer of conductive material may be in the form of patches such as patch 512, traces, and other geometric shapes which may be employed in other radio subsystems or substructures for example. The foregoing descriptions of preferred embodiments of the invention are purely illustrative and are not meant to be limiting in nature. Those skilled in the art will appreciate that a variety of modifications are possible while remaining within the scope of the present invention.

The present invention has been described primarily as methods and structures for fabricating lightweight cavity filter structures and radio subsystems. In this regard, the methods and structures for fabricating lightweight cavity filter and radio subsystem structures are presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications such as laminating techniques of light dielectric material as considered necessary by the particular application(s) or use(s) of the present invention.

What is claimed is:

1. A cavity filter, comprising:

an insulated foam housing having a contoured surface of an inverse of a cavity filter structure to provide one or more foam-filled cavities;

an electro-less plated layer of first metal deposited onto the contoured surface of the insulated foam housing; and an electro-plated layer of second metal deposited on top of the layer of first metal, wherein a total thickness of the layers of first and second metal is between one and three skin depths associated with an operating radio frequency of the cavity filter structure and is less than or equal to 5 micrometers, and wherein the layer of first metal comprises electro-less plated silver and the layer of second metal comprises electro-plated copper.

2. A cavity filter as set out in claim 1, wherein the insulated foam housing comprises polystyrene foam.

3. A cavity filter as set out in claim 1, wherein the total thickness of the layers of first and second metal is in a range of approximately 2 micrometers to approximately 5 micrometers.

4. A method for forming a lightweight cavity filter structure, comprising:

providing an insulated foam housing having a contoured surface of a cavity filter structure or inverse thereof;

depositing a first layer of metal onto a surface of the insulated foam housing employing an electro-less plating process; and, depositing a second layer of metal on top of the first layer of metal employing an electroplating process;

wherein a total thickness of the first and second layers of metal is between one and three skin depths associated with an operating radio frequency of the cavity filter structure and is less than or equal to 5 micrometers, and wherein the first layer of metal comprises electro-less plated silver and the second layer of metal comprises electro-plated copper.

5. A method for forming a lightweight cavity filter structure as set out in claim 4, wherein the foam housing comprises polystyrene foam.

* * * * *